US009567989B2

(12) United States Patent
Bauer et al.

(10) Patent No.: US 9,567,989 B2
(45) Date of Patent: Feb. 14, 2017

(54) METHOD FOR OPERATING A FEED PUMP OPERATING IN A PULSATING MANNER AND MOTOR VEHICLE HAVING A FEED PUMP

(71) Applicant: EMITEC GESELLSCHAFT FUER EMISSIONSTECHNOLOGIE MGH, Lohmar (DE)

(72) Inventors: Peter Bauer, Siegburg (DE); Jan Hodgson, Troisdorf (DE); Georges Maguin, Marly (FR)

(73) Assignee: EMITEC Gesellschaft fuer Emissionstechnologie mbH, Lohmar (DE)

( * ) Notice: Subject to any disclaimer, the term of this patent is extended or adjusted under 35 U.S.C. 154(b) by 100 days.

(21) Appl. No.: 14/257,158

(22) Filed: Apr. 21, 2014

(65) Prior Publication Data

US 2014/0227107 A1 Aug. 14, 2014

Related U.S. Application Data

(63) Continuation of application No. PCT/EP2012/070634, filed on Oct. 18, 2012.

(30) Foreign Application Priority Data

Oct. 21, 2011 (EP) ..... 11290489

(51) Int. Cl.
*F04B 43/04* (2006.01)
*F04B 39/00* (2006.01)
(Continued)

(52) U.S. Cl.
CPC ..... *F04B 39/0027* (2013.01); *F04B 17/044* (2013.01); *F04B 43/04* (2013.01); *F04B 49/065* (2013.01)

(58) Field of Classification Search
CPC F04B 2205/05; F04B 2205/11; F04B 2205/13
See application file for complete search history.

(56) References Cited

U.S. PATENT DOCUMENTS 7,393,187 B2 7/2008 Weigl
7,654,080 B2 2/2010 Ripper et al.
(Continued)

FOREIGN PATENT DOCUMENTS

DE 102004054238 A1 5/2006
DE 102007017459 A1 10/2008
(Continued)

*Primary Examiner* — Patrick Hamo
(74) *Attorney, Agent, or Firm* — Laurence A. Greenberg; Werner H. Stemer; Ralph E. Locher

(57) ABSTRACT

A method for operating a feed pump operating in a pulsating manner in a feed unit to feed a liquid operating substance in a feeding direction, is used in a motor vehicle. The feed pump has a feed piston and a drive coil for driving the feed piston. The feed unit has a pressure sensor downstream of the feed pump in the feeding direction. A voltage profile is firstly applied to the drive coil. A feed stroke of the feed piston is subsequently carried out in accordance with the voltage profile. In this context, a pressure profile in the feed unit downstream of the feed pump in the feeding direction is monitored. This pressure profile is subsequently evaluated. The voltage profile is subsequently adapted as a function of at least one characteristic property of the pressure profile. A motor vehicle having a feed pump is also provided.

6 Claims, 4 Drawing Sheets

(51) Int. Cl.
*F04B 49/06* (2006.01)
*F04B 17/04* (2006.01)

(56) References Cited

U.S. PATENT DOCUMENTS

| | | | | |
|---|---|---|---|---|
| 8,250,855 | B2 | 8/2012 | Kleinknecht | |
| 9,140,165 | B2 * | 9/2015 | Bauer | F01N 3/208 |
| 2009/0077949 | A1 | 3/2009 | Kleinknecht | |
| 2011/0023466 | A1 | 2/2011 | Branco et al. | |
| 2013/0025268 | A1 | 1/2013 | Bauer et al. | |

FOREIGN PATENT DOCUMENTS

| | | | |
|---|---|---|---|
| WO | 03050416 | A1 | 6/2003 |
| WO | 2011120839 | A1 | 10/2011 |

* cited by examiner

METHOD FOR OPERATING A FEED PUMP OPERATING IN A PULSATING MANNER AND MOTOR VEHICLE HAVING A FEED PUMP

CROSS-REFERENCE TO RELATED APPLICATION

This is a continuation, under 35 U.S.C. §120, of copending International Application No. PCT/EP2012/070634, filed Oct. 18, 2012, which designated the United States; this application also claims the priority, under 35 U.S.C. §119, of European Patent Application No. 11 290 489.1, filed Oct. 21, 2011; the prior applications are herewith incorporated by reference in their entirety.

BACKGROUND OF THE INVENTION

Field of the Invention

The invention relates to a method for operating a feed pump which operates in a pulsating manner. Such feed pumps are used, for example, in feed units for feeding liquid operating substances in motor vehicles. Liquid operating substances in motor vehicles are, inter alia, fuels for internal combustion engines, fluids used with windshield wipers for cleaning windows of motor vehicles, cooling fluids or lubricating fluids for internal combustion engines and reducing agents for cleaning exhaust gases of internal combustion engines.

In particular, reducing agents for cleaning the exhaust gases of internal combustion engines have been recently used to a greater extent. Such reducing agents are required in exhaust gas treatment devices in order to convert the noxious components in the exhaust gas together with the reducing agent. Such an exhaust gas treatment method is the method of selective catalytic reduction [SCR=selective catalytic reduction]. In that method, a reducing agent which contains or makes available ammonia is fed to the exhaust gas of the internal combustion engine. The ammonia in the reducing agent is then converted in the exhaust gas together with the nitrogen oxide compounds. In that context, non-damaging reaction products such as water, carbon dioxide and nitrogen are produced. Ammonia is normally not stored directly itself in motor vehicles but rather in the form of a reducing agent precursor. A frequently used precursor is aqueous urea solution. The term "reducing agent" is also used below for reducing agent precursor.

In exhaust gas treatment devices, relatively small quantities of reducing agent are required. The consumption of reducing agent is normally between 2% and 10% of the consumption of fuel by the internal combustion engine. For that reason, feed pumps which operate in a pulsating fashion (in an intermittent or reciprocating fashion) have proven particularly valuable for feeding reducing agents. Feed pumps which operate in a pulsating fashion are particularly cost effective and allow precise adjustment of the feed quantity.

A disadvantage of feed pumps which operate in a pulsating fashion is, in particular, the efficiency and the generation of noise of the feed pump due to the feed stroke and high power losses which lead to considerable generation of heat in the feed pump. In particular, the generation of heat can lead to problems when feeding thermally sensitive liquids (such as, for example, a urea/water solution).

SUMMARY OF THE INVENTION

It is accordingly an object of the invention to provide a method for operating a feed pump operating in a pulsating manner and a motor vehicle having a feed pump, which overcome the hereinafore-mentioned disadvantages and at least alleviate the highlighted technical problems of the heretofore-known methods and vehicles of this general type. The intention is, in particular, to disclose a method for operating a feed pump which operates in a pulsating fashion and by which the feed pump can be operated in a particularly economical fashion in terms of energy and with low noise.

With the foregoing and other objects in view there is provided, in accordance with the invention, a method for operating a feed pump operating in a pulsating manner, wherein the feed pump has a feed piston and a drive coil for driving the feed piston, a feed unit has a pressure sensor downstream of the feed pump in the feeding direction, and the method comprises at least the following steps:

a) applying a voltage profile to the drive coil;
b) carrying out a feed stroke of the feed piston in accordance with the voltage profile;
c) monitoring a pressure profile in the feeding direction downstream of the feed pump;
d) evaluating the pressure profile; and
e) adapting the voltage profile as a function of at least one characteristic property of the pressure profile.

The method according to the invention is based on the concept of adapting the voltage profile for driving the feed pump in such a way that a pressure profile in the feed line is particularly advantageous, for example by virtue of the fact that it corresponds to a predefined set point pressure profile. A pressure profile in a feed line is, in particular, a chronological pressure profile which occurs in the feed line due to a stroke of the feed pump which operates in a pulsating fashion. In the simplest case, the voltage profile for driving the drive current is a simple square wave signal which is defined by the absolute value of an applied voltage and duration of the applied voltage. Any desired voltage profiles with a relatively complex structure are conceivable.

Consequently, a control method is also proposed herein in which the pressure profile of a feed stroke from step b) is evaluated which occurs in accordance with a predefined voltage profile (step a)) in step d) and an adapted voltage profile is predefined in step a) for a following step b). This control process can be carried out often enough until the evaluated pressure profile in step d) corresponds to a predefined set point pressure profile. The "adaptation" of the voltage profile includes, in particular, one of the following measures: changing of the voltage amplitude, changing of the duration of the voltage, changing of the chronological voltage profile (increase/decrease; holding times etc.).

The feed pump is preferably a component of a feed unit feeding a liquid operating material for a motor vehicle with a predefined feeding direction, in particular for feeding liquid reducing agents such as urea/water solution. It is also preferred that the pressure sensor be a component of the feed unit so that in this case, in particular, the monitoring of pressure also takes place within the feed unit.

In accordance with another particularly advantageous mode of the method of the invention, the voltage profile has an overall duration and a first voltage, and at least the overall duration or the first voltage is adapted in step d). The overall duration relates in this case to the time period from a starting value of the voltage (for example zero volts) to the start of the feed stroke up to an end value of the voltage (for example zero volts again) at the end of the same feed stroke. The "first voltage" constitutes in this case, in particular, a first (predefined) voltage amplitude, in particular at the end of the overall duration of the voltage profile or during the feed stroke itself. Consequently, in the method at least one of these characteristic variables of the voltage profile in step e) is adapted for the next feed stroke.

In accordance with a further advantageous mode of the method of the invention, the voltage profile starts with an activation interval with an activation voltage, wherein the activation voltage is increased over the first voltage. The increased activation voltage serves firstly to set the feed piston of the feed pump in motion. For this purpose, an increased voltage is necessary. When the piston has been set in motion, all that is necessary is to move the piston on within the feed pump. It is therefore possible to operate with a relatively low first voltage. Accordingly, the timing of the activation voltage of the first voltage mentioned above is moved forward in a voltage profile.

In accordance with an added particularly advantageous mode of the method of the invention, a first time of a pressure peak is determined as a characteristic property of the pressure profile, and at least one of the following variables of the voltage profile is adapted as a function of the first point in time:

overall duration;
first voltage;
activation interval; or
activation voltage.

The generation of noise and the efficiency of the feed pump can be improved in this way. It is possible, for example, to ensure that the feed piston strikes less hard or even not at all against a stop within the feed pump (if appropriate this is, in fact, the cause of the measured, undesirably high pressure peak) by virtue of the fact that the voltage profile is correspondingly changed. For example, the overall duration of the voltage profile can be selected in such a way that the feed piston is not accelerated further when a pressure peak is reached.

In accordance with an additional mode of the method of the invention, at least a second time at which a pump valve opens or a third point in time in which a pump valve closes is determined as a characteristic property of the pressure profile, and in addition at least one of the following variables of the voltage profile is adapted as a function of at least the second point in time or of the third point in time:

overall duration;
first voltage;
activation interval; or
activation voltage.

This also includes the fact that the pressure values of the pressure profile are determined both at the second point in time and at the third point in time, and the voltage profile and its parameters are adapted to the second point in time and to the third point in time.

The valve opening times of the feed pump and the valve closing times of the feed pump can be detected in the pressure profile which the pressure sensor measures. The valve opening can be detected, for example, when the pressure profile first rises. The closing process of the valve can be detected, for example, from a drop in pressure. Lag times, which last until a valve movement has an effect on the pressure sensor, could also be taken into account.

If appropriate, a further pressure sensor can be disposed within the feed pump, and a comparison of the pressure measured there with the pressure in the feed line can take place, as a result of which certain times or properties of the pressure profile can then be detected particularly precisely by using a measurement of a pressure difference.

In accordance with yet another advantageous mode of the method of the invention, the voltage profile is generated from a supply voltage using pulse width modulation. The supply voltage is in this case the voltage made available by a voltage source (constant) for the operation of the feed pump.

In accordance with yet a further mode of the method of the invention, a current profile in the drive coil is monitored in parallel with step c) and is used at least during the evaluation of the pressure profile in step d) or during the adaptation of the voltage profile in step e). It is possible to provide additional monitoring measures or monitoring devices for the parallel (simultaneous) monitoring of the current profile. In addition it is also possible for knowledge from this current profile to be used both for step d) and for step e).

In accordance with yet an added advantageous mode of the method of the invention, at least one parameter from the following group of further parameters is used at least during the evaluation of the pressure profile in step d) or during the adaptation of the voltage profile in step e):

energy consumption of the drive coil during a feed stroke;
outputting of energy by the feed pump to the liquid operating substance; or
a return flow of energy from the drive coil after termination of a feed stroke.

The pump can also be considered energetically within the scope of the method. The energy consumption of the feed pump through the drive coil during a feed stroke can be determined by using the current flowing through the coil and the applied voltage profile. The outputting of energy of the feed pump to the liquid operating substance can be determined, for example, by using the volume flow of the feed pump in combination with the feed pressure of the feed pump and/or the increase in pressure caused by the feed pump. If appropriate, measurement is possible by using a second pressure sensor. It would therefore be possible to determine a volume flow by measuring a pressure difference. The return flow of energy from the drive coil after the end of a feed stroke can be measured with a corresponding synchronously operating diode.

An efficiency level of the feed pump and/or a power loss of the feed pump can be calculated with a comparison of the outputting of energy of the feed pump to the liquid operating substance with the energy consumption of the feed pump through the drive coil during a feed stroke. The voltage profile which is predefined to the feed pump can therefore be adapted in such a way that the efficiency level is particularly high or that the predefined quantity of energy is not sufficient for the feed piston to move against a stop with a high impetus. Particularly advantageous operation of the feed pump in the partial stroke can therefore be implemented.

In accordance with yet an additional advantageous mode of the method of the invention, the feed pump can be operated with a frequency of more than 10 feed strokes per second, and more than 20 feed strokes occur before a feed stroke is carried out with an adapted voltage profile.

The feed pump is frequently monitored in the engine control or controller of a motor vehicle. The controller is disposed at a large spatial distance from the feed pump. Moreover, the computing capacities which are available in the engine controller are not (always) sufficient to permit adaptation of the voltage profile for carrying out a feed stroke within a few milliseconds. For this reason it is advantageous if an adapted voltage profile does not have an effect until more than 20 feed strokes after the measurement of a pressure profile. An adapted voltage profile preferably no longer has an effect after 50 feed strokes and, in particular, after 100 feed strokes after the measurement of a pressure profile. A long lag time or delay is therefore produced in the adaptation control loop which is formed by the method according to the invention. It is also possible for a lag time of at least 1 second, preferably at least 5 s [seconds] and particularly preferably at least 10 s to occur between step a) and step e). However, this makes it possible for the calculations which are necessary for the method according to the invention to be carried out in a remote control unit with a comparatively small computing power.

If appropriate, correspondingly adapted voltage profiles (set point voltage profiles) can also be stored for specific pressure pulse patterns (characteristic profiles of the actual pressure profile) of the feed pump. These stored predefined voltage profiles can then be used to operate the feed pump if corresponding conditions are present in the feed unit. The conditions in the feed pump can be defined, for example, on the basis of the temperature in the feed unit and/or the present consumption of liquid operating substance.

If a (separate) control unit which can carry out the method according to the invention is provided within the feed unit for feeding the liquid operating substance itself, it is also possible to carry out the method during a substantially lower number of feed strokes, with the result that the lag time (or delay) of the method is significantly shorter.

With the objects of the invention in view, there is also provided a method for operating a feed pump operating in a pulsating manner, wherein the feed pump has a feed piston and a drive coil for driving the feed piston, and the method comprises at least the following steps:

i. applying a voltage profile to the drive coil;
ii. carrying out a feed stroke of the feed piston in accordance with the voltage profile;
iii. monitoring of a temperature at the feed unit; and
iv. adapting the voltage profile as a function of at least the temperature.

The particular advantages and configuration features which are illustrated for the method for adapting the voltage profile as a function of the pressure can be applied and transferred in an analogous fashion to the method illustrated herein for adapting the voltage profile as a function of the temperature. The same applies to the special advantages and configuration features which are described below for the method for adapting the voltage profile as a function of the temperature and which can be applied and transferred in an analogous fashion to the method for adapting the voltage profile as a function of the pressure.

In particular, both methods can also be combined with one another, with the result that the adaptation of the voltage profile takes place as a function of at least the temperature or the pressure/pressure profile. In summary, the voltage profile can accordingly be adapted as a function of a (current) measure of the operating state of the feed pump.

This applies specifically to the configuration of the feed pump, of the feed piston and of the drive coil as well as of the feed device and of the pressure sensor. This also applies specifically to the individual properties of the voltage profile, which can be adapted within the scope of the adaptation.

The temperature can be monitored with a temperature sensor which can be disposed at a location in the surroundings of the feed unit and/or in direct contact with the feed unit. The temperature sensor can, for example, be mounted on a base plate in the feed unit, at which base plate the feed pump is also mounted. It is also possible for the temperature sensor to be disposed directly on the feed pump. In a further embodiment variant, the temperature is measured by using the drive coil of the feed pump. The drive coil typically has a temperature dependent electrical resistance. The electrical resistance of the drive coil can be inferred from the voltage profile and from the current flow through the drive coil which occurs as a result of the voltage profile. Given a known temperature dependence of the electrical resistance, the temperature of the drive coil can be calculated from this electrical resistance.

In feed units with feed pumps which operate in a pulsating fashion, very high energy losses regularly occur during the conversion of the electrical energy which is introduced into the drive coil for the purpose of feeding the volume and increasing the pressure. These energy losses have already been described in detail above. In addition to the high power consumption, the energy losses also lead to strong heating of the feed pump. This heating can in some cases be desired, for example if the feed pump is used at the same time to heat the feed unit through its power loss. This may be advantageous in order to melt reducing agent which is frozen in the feed unit and/or to avoid the freezing of reducing agent in the feed unit. However, if the temperature of the feed unit or of the feed pump exceeds a limiting temperature (which is, for example, between 80° C. and 120° C.), further heating by the power loss is undesired in this case. At raised temperatures, it is possible, in particular when the feed pump feeds urea/water solution as a reducing agent, for deposits to form, which can lead to significant damage to the pump. The deposits can act like sandpaper particles which can damage the pump. The feeding accuracy and/or the efficiency level of the feed pump can be reduced in this way. It is therefore advantageous to avoid high temperatures in the feed pump. This may be achieved, in particular, by adapting the voltage profile as a function of the temperature.

The voltage profile is preferably adapted in such a way that the temperature in the feed pump or the temperature in the feed unit does not exceed a defined limiting temperature. The (maximum) limiting temperature is, for example, 120° C., 100° C. or even only 80° C. Furthermore, intermediate temperatures which are lower than the predefined limiting temperature can be predetermined. Therefore, if the limiting temperature and/or the predefined intermediate temperature/temperatures is/are reached, the voltage profile which has applied until then is changed.

In one preferred embodiment variant, the two methods for adapting to the pressure and for adapting to the temperature are both carried out in combination. The voltage profile is then adapted both to the temperature and to characteristic properties of a pressure profile. The adaptation of the voltage profile to the properties of a pressure profile also serves, inter alia, to reduce the power loss which occurs during operation of the feed pump. If the temperature in the feed pump or in the feed unit is as far as possible no longer to be increased, the feed pump should be operated with a lower power loss. In this case, in order to reduce the temperature, the voltage profile can be adapted, on the basis of the pressure profile as described further above.

In order to start a pump stroke, a particularly high activation voltage can be used in order to set the feed piston in motion as quickly as possible. If the activation voltage is particularly large, the necessary current or the necessary current strength to set the feed piston in motion is reached particularly quickly. As a result, the energy loss is particularly reduced because this current flow only then occurs for a shortened time interval due to the necessary current strength being reached more quickly. Furthermore, an activation interval, for which the activation voltage is present at the drive coil, can also be adapted. With respect to the adaptation of the activation voltage and/or the activation interval, explicit reference will be made once more to the explanations given above with respect to the adaptation of the activation voltage and of the activation interval within the context of the adaptation to the pressure, which explanations are incorporated herein by reference in their full scope.

The maximum current which flows through the coil during a pump stroke can be reduced. The maximum current can be reduced by virtue of the fact that a first voltage for generating the current flow during the motion of the piston is reduced to such an extent that the maximum current is reduced to the necessary current or the necessary current strength (for the, in particular, continuous or constant motion). The necessary current is, in other words, also that current which is necessary to place the feed piston (just) in motion. In order to ensure that the feed piston is reliably set in motion (and moves at a sufficient speed), the maximum current should be predetermined and increased by an interval (for example a value between 1 percent and 10 percent, preferably between 2 percent and 5 percent) above the necessary current or the necessary current strength. With respect to the adaptation of the first voltage, explicit reference will be made once more to the explanations given further above with respect to the adaptation of the first voltage within the scope of the adaptation to the pressure, which are incorporated by reference herein to their full scope.

Furthermore, the overall duration of a current pulse or of the current pulse which is provided for placing the feed piston in motion can be reduced. If the feed piston has reached its ultimate position (if appropriate against a stop in the feed pump) and the current pulse or the current flow continues, the entire current flow constitutes a power loss. For this reason, it is advantageous to adapt the overall duration of the current pulse or of the current pulse which is provided for a specific motion of the feed piston, in such a way that this overall duration corresponds to the time interval of the motion of the feed piston. The overall duration of the current pulse or of the current flow preferably ends when the feed motion of the feed piston ends. It is also possible for the overall duration of the current flow to end a short time period before or after the end of the feed motion. Premature ending of the current flow before the end of the feed motion permits strong impacting of the feed piston against a stop to be reduced. A subsequent end of the current flow after the end of the feed motion makes it possible to ensure that the feed motion is carried out completely in every case. With respect to the adaptation of the overall duration, explicit reference is made once more to the explanations given further above with respect to the adaptation of the overall duration within the scope of the adaptation to the pressure, which are incorporated herein by reference to their full scope.

As a result of the fact that the current profile of the current pulse or of the current flow for activating the feed piston or the voltage which is made available and by using which the current profile is produced, is generated by using pulse width modulation, it is possible to make the current profile independent of the on board power system of a motor vehicle and, in particular, independent of the voltage made available by the on board power system. The voltage of the on board power system fluctuates, for example, as a function of to what extent a battery in the motor vehicle is charged, to what extent current is fed into the on board power system through a generator and/or how many loads are connected to the battery. The on board power system of a motor vehicle with 12 volts sometimes makes available, for example, only between 9 volts and 12 volts for a feed unit in the starting phase of the motor vehicle, while in the regular operation of the feed unit, for example, between 13 and 14 volts are made available. It is proposed that a current profile, which is (largely) independent of the voltage which is made available, is generated for the feed pump by using pulse width modulation from the voltage which is made available by the on board power system.

If a relatively low voltage is made available to the drive coil in order to move the feed piston, the current flow for moving the feed piston is established more slowly and the motion of the feed piston lasts longer. As a result, the power losses due to the current in the coil (that is to say the energy which is converted directly into heat by the resistance of the coil and does not lead to a motion of the feed piston) become larger. In particular, during the starting phase of a motor vehicle it is possible, as explained further above, for only a relatively low voltage to be regularly made available. In the starting phase, the feed pump is, however, still cold, with the result that the produced heat which is increased due to the low voltage is not so problematic in this case. During the operation after the termination of a starting phase of a motor vehicle, the on board power system can regularly make available relatively high voltages again. The heat which is produced by the drive coil can be reduced with the methods proposed herein.

With the objects of the invention in view, there is concomitantly provided a motor vehicle, comprising a tank for a liquid operating substance and a feed unit with a feed pump which operates in a pulsating fashion and has the purpose of feeding the operating substance out of the tank, as well as a control unit which is configured to operate a feed pump with a method according to the invention. The control unit, controller or computer can, for this purpose, be equipped with a suitable data processing program, characteristic diagrams, sensors, signal lines, etc. In this context, reference is also made, in particular, to the following description of the figures.

Other features which are considered as characteristic for the invention are set forth in the appended claims, noting that the features which are specified individually in the claims can be combined with one another in any desired technically appropriate way and can be supplemented by explanatory contents from the description, in which further embodiment variants of the invention are indicated.

Although the invention is illustrated and described herein as embodied in a method for operating a feed pump operating in a pulsating manner and a motor vehicle having a feed pump, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
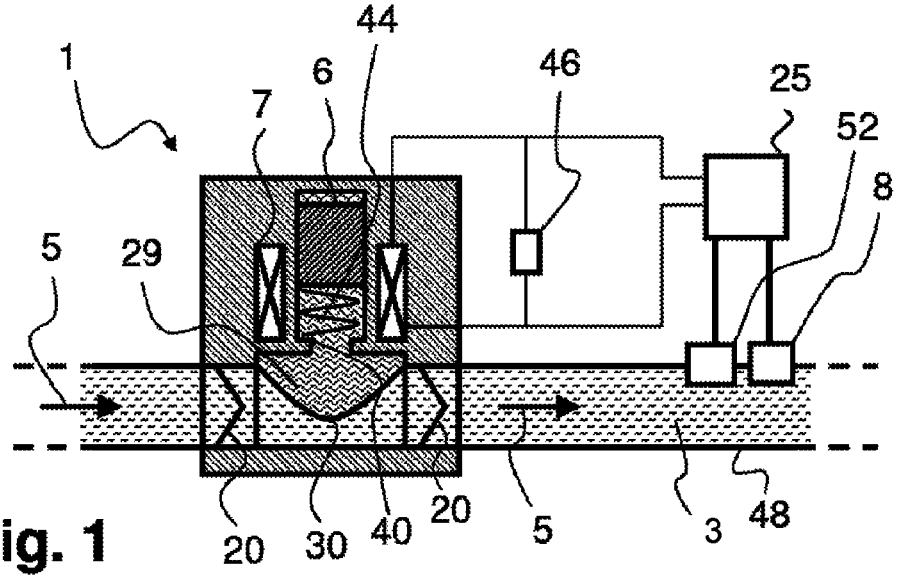
FIG. 1 is a diagrammatic, partly-sectional view of a feed unit which is configured and constructed for a method according to the invention.

Referring now in detail to the figures of the drawing for explaining the invention and the technical field in more detail by showing particularly preferred structural variants to which the invention is not restricted and in which size ratios are diagrammatic, and first, particularly, to FIG. 1 thereof, there is seen a feed pump 1 which can feed a liquid operating substance 3 (in particular a urea/water solution) through a line 48, illustrated in certain sections, in a feeding direction 5. A pressure sensor 8 is provided downstream of the feed pump 1 in the feeding direction 5. A control unit 25 receives signals from the pressure sensor 8 for controlling the feed pump 1. The feed pump 1 is a feed pump which operates in a pulsating fashion or manner and is driven by a drive coil 7. The drive coil 7 drives a feed piston 6. The feed piston 6 can be moved back and forth by the drive coil 7 and a restoring spring 44. The force of the feed piston 6 is transmitted to a diaphragm 30 through a transmission fluid 29. The diaphragm 30 then transmits the force of the feed piston 6 to the operating substance 3. The feeding direction 5 through the line 48 is predefined by pump valves 20, which preferably open and/or close passively. A so-called free-wheeling diode 46, which is connected parallel to the drive coil 7 of the feed pump 1, absorbs a current which is induced in the drive coil 7 by the restoring spring 44 when the feed piston 6 moves back. Furthermore, a temperature sensor 52 is provided on the feed pump 1.

Figure 2:
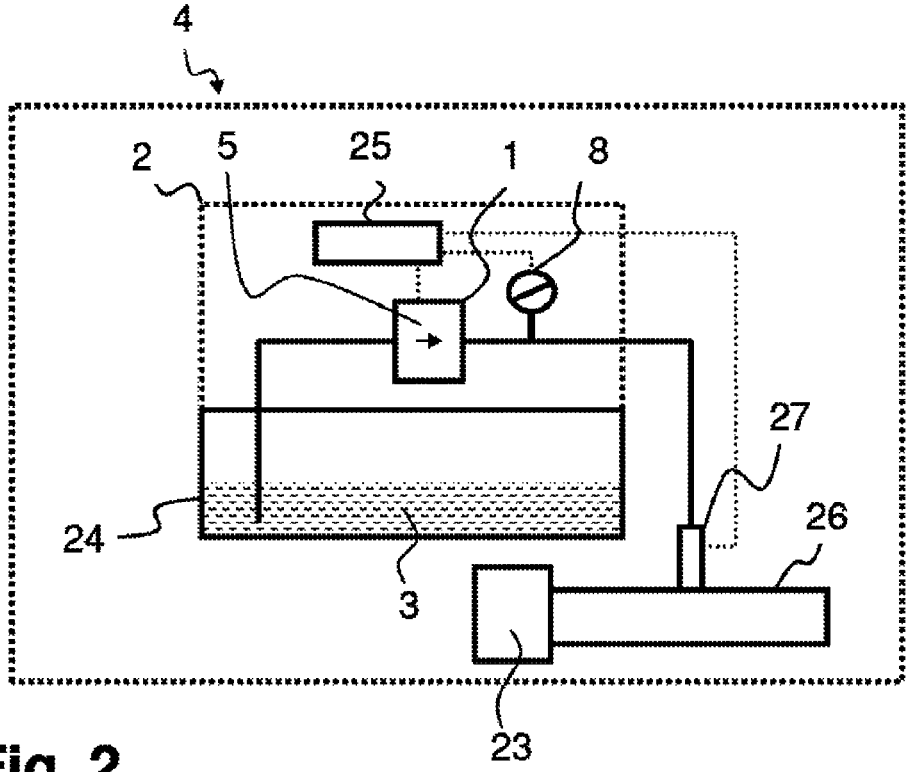
FIG. 2 is a block diagram of a motor vehicle having a feed unit for a method according to the invention.

FIG. 2 shows a motor vehicle 4 having an internal combustion engine 23 and an exhaust gas treatment device 26 into which an operating substance can be fed through an injector 27 (in droplet form). The injector 27 is supplied with an operating substance 3 from a tank 24 by a feed unit 2 having a feed pump 1. The operating substance 3 is preferably a reducing agent (in particular a urea/water solution) for cleaning the exhaust gases of the internal combustion engine 23. A pressure sensor 8 and a control unit 25 for controlling the feed pump 1 are illustrated within the feed unit 2. The operating substance 3 flows from the tank 24 to the injector 27 in a predefined feeding direction 5.

Figure 3:
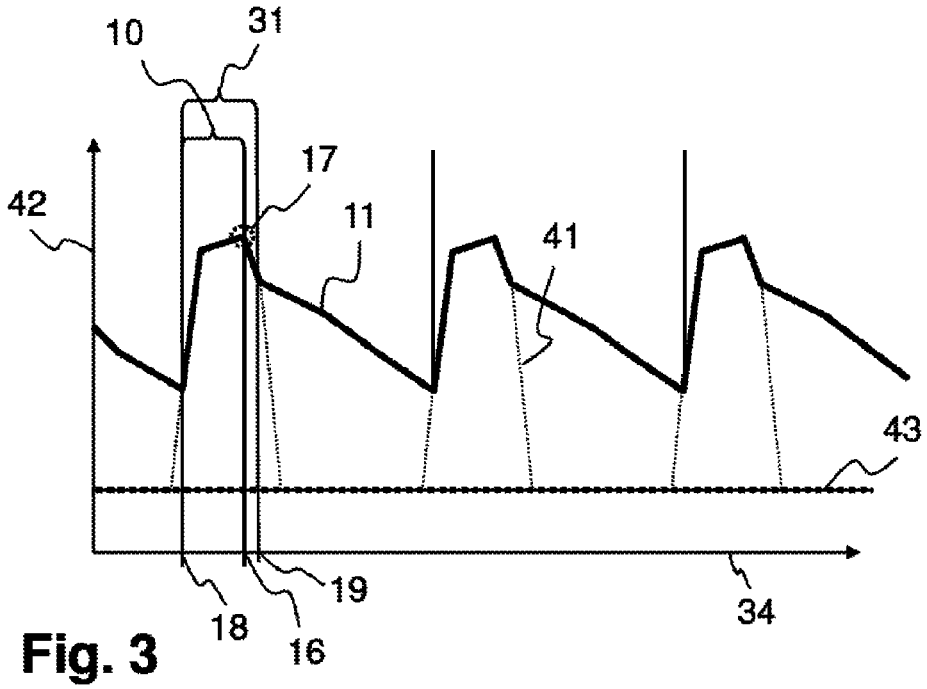
FIG. 3 is a diagram showing pressure profiles.

FIG. 3 shows pressure profiles plotted on a pressure axis 42 against a time axis 34, in a feed unit. A pre-pumping pressure 43, that is to say a pressure upstream of the feed pump, is illustrated by a dotted line. A thick line shows a pressure profile 11 which has been determined at a pressure sensor disposed downstream of the feed pump in the feeding direction. The pressure profile 11 is intermittent on the basis of the pulsating feed motion of the feed pump. A pump chamber pressure 41, that is to say a pressure in the feed pump, is plotted in dashed lines. The pump chamber pressure 41 varies between the pressure profile and the pre-pumping pressure 43. A first point of time 16 of a pressure peak 17 in the pressure profile 11 can be also be seen in FIG. 3. Furthermore, a second point of time 18 of a valve opening of the feed pump and a third point of time 19 of a valve closure of the feed pump can be seen. The valve opening of the feed pump occurs whenever the pump chamber pressure 41 reaches the pressure profile 11 which is present downstream of the feed pump in the feeding direction. The valve closes when the pump chamber pressure 41 drops below the pressure profile 11.

Figure 4:
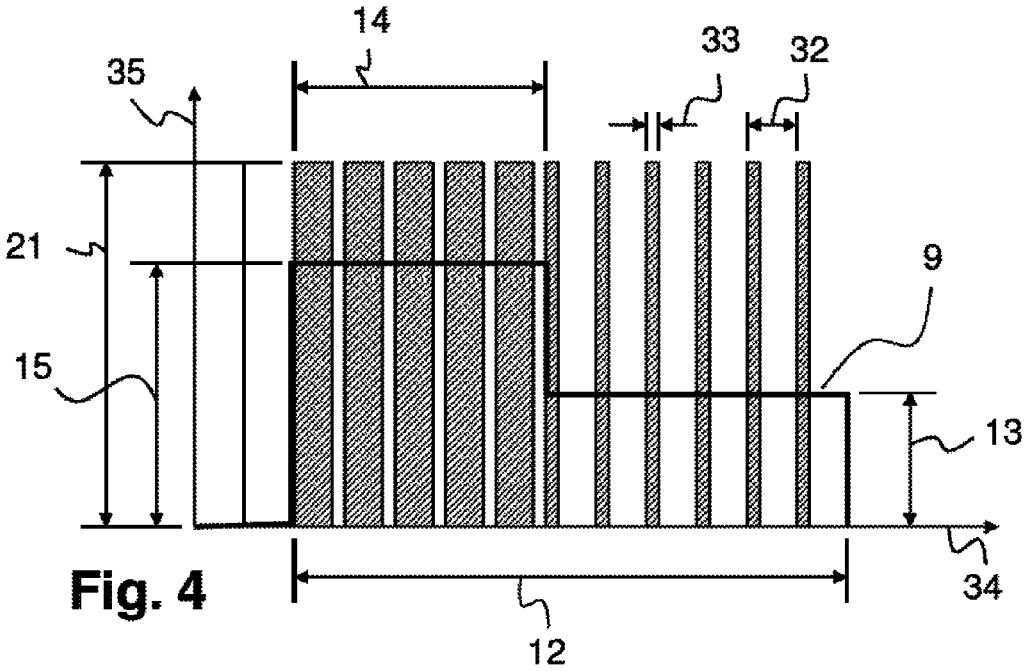
FIG. 4 is a diagram showing an example of pulse width modulation.

FIG. 4 shows an example of a voltage profile 9 which is produced by using pulse width modulation. The voltage profile 9 is plotted on a voltage axis 35 against a time axis 34. The voltage profile 9 starts with an activation voltage 15 which is present for a chronological activation interval 14. The voltage profile 9 then drops to a first voltage 13. Overall, the voltage profile 9 has an overall duration 12. The activation voltage 15 and the first voltage 13 are generated from a supply voltage 21 using pulse width modulation. During pulse width modulation, a fixed clock length 32 is predefined. A pulse width 33 of this supply voltage 21 is varied within the clock length 32. The voltage profile 9 arises from the pulsed supply voltage 21 by using a corresponding damping circuit.

Figure 5:
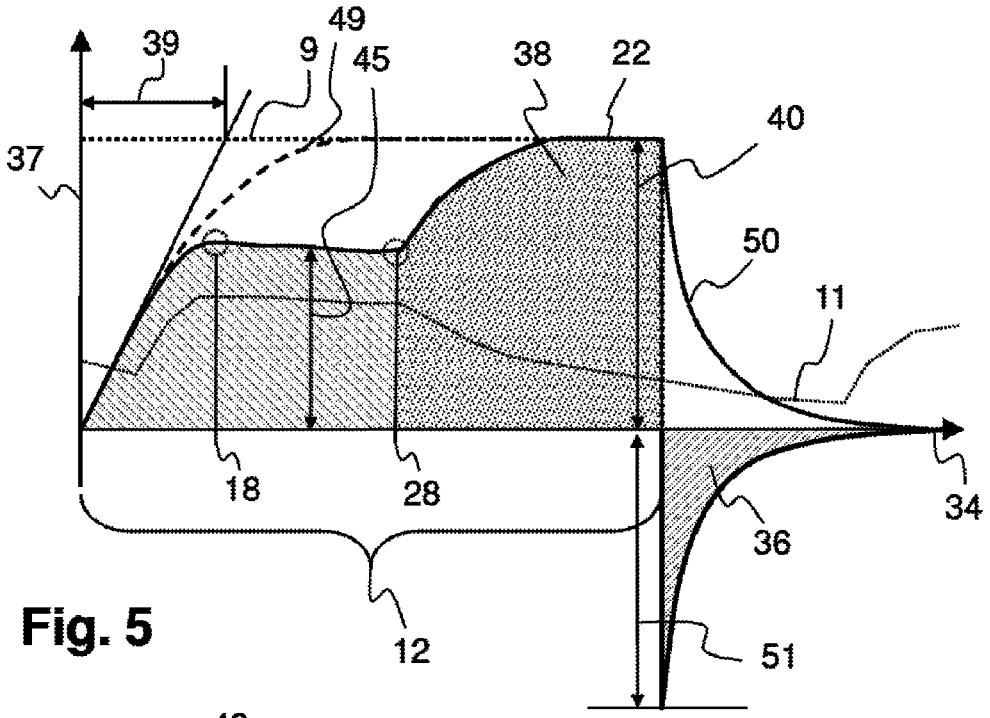
FIG. 5 is a diagram showing a current profile in a coil.

FIG. 5 is a diagram of a current profile 22 during a pump pulse. The current profile 22 is plotted on a current axis 37 against a time axis 34. The pressure profile 11 in the feed unit is illustrated diagrammatically (in the background). The voltage profile 9 is also illustrated diagrammatically in the background. The chronological reference of the current profile 22 with respect to the voltage profile 9 and with respect to the pressure profile 11 will now be explained. The voltage profile 9 is a square main voltage in this case for the sake of simplicity. Furthermore, an idealized current profile 49 is illustrated diagrammatically in the background. This idealized current profile 49 shows how the current in the drive coil would be if the feed piston of the feed pump were not to carry out a feeding motion.

The idealized current profile 49 and the current profile 22 both start with an initial gradient 39 at the beginning of the voltage profile. This initial gradient 39 is predefined by the resistance of the drive coil and the inductance of the drive coil.

As soon as the feed piston of the feed pump starts to move at a second time 18, the voltage profile 22 and the idealized voltage profile 49 move away from one another differently. The idealized voltage profile 49 continues to increase, while the voltage profile 22 remains approximately level at a fourth point of time, in the case of an operating current 45, for a time interval up to a stop of the feed piston. This is due to the fact that the motion of the feed piston induces an opposing voltage in the drive coil 7 which leads to a slowing down of the increase in the voltage profile 22. Approximately a plateau is therefore produced during the motion of the feed piston. The level of the plateau or the size of the operating current 45 are approximately proportional to the force generated by the feed piston, or to the increase in pressure brought about by the feed pump.

As soon as the feed piston has come to a stop at a fourth point of time 28, the current profile 22 continues to rise in accordance with the idealized current profile 49. The profile of the current profile 22 is offset only in a chronologically following fashion compared to the idealized current profile 49. The idealized current profile 49 and the current profile 22 both increase up to a maximum current 40. This maximum current 40 is defined by the electrical resistance of the drive coil. The inductance of the drive coil plays no role in this case because the magnetic field of the drive coil is completely built up at this time.

The relationship of the operating current 45 to the maximum current 40 is informative for the efficiency level of the feed pump: the higher the operating current 45 in relationship to the maximum current 40, the greater the amount of electrical energy which cannot be used to move the feed piston but is instead converted into thermal energy by the electrical resistance of the drive coil. The operating current 45 is preferably less than 30%, in particular less than 15% and particularly preferably less than 5% of the maximum current 40.

As soon as the voltage profile 9 has ended after the expiration of the overall duration 12, the current drops away with a current drop profile 50. Due to the magnetic energy which is stored by the drive coil, the current does not drop away in an immediately abrupt fashion. The dissipation of the energy stored in the form of a magnetic field by the drive coil leads to an induced negative voltage 51. A return flow 36 of energy from the drive coil 7 is therefore produced. This return flow of energy can, for example, be consumed in a freewheeling diode so that the induced negative voltage 51 does not lead to a destruction of electrical components.

After the fourth point of time 28, when the feed piston has reached its stop, the electrical energy which continues to be introduced into the drive coil by the voltage profile 9 and the current profile 22 is converted directly into heat on the basis of the electrical resistance of the drive coil and therefore merely generates an energy loss 38. This no longer results in a feeding effect. The energy loss 38, which is shown in FIG. 5, is illustrated in exaggerated form for the sake of illustration. The energy loss 38 is relatively large because the current profile 22 is continued so far that it almost reaches the maximum voltage 45. Such conditions normally do not occur in real use of a feed pump.

Figure 6:
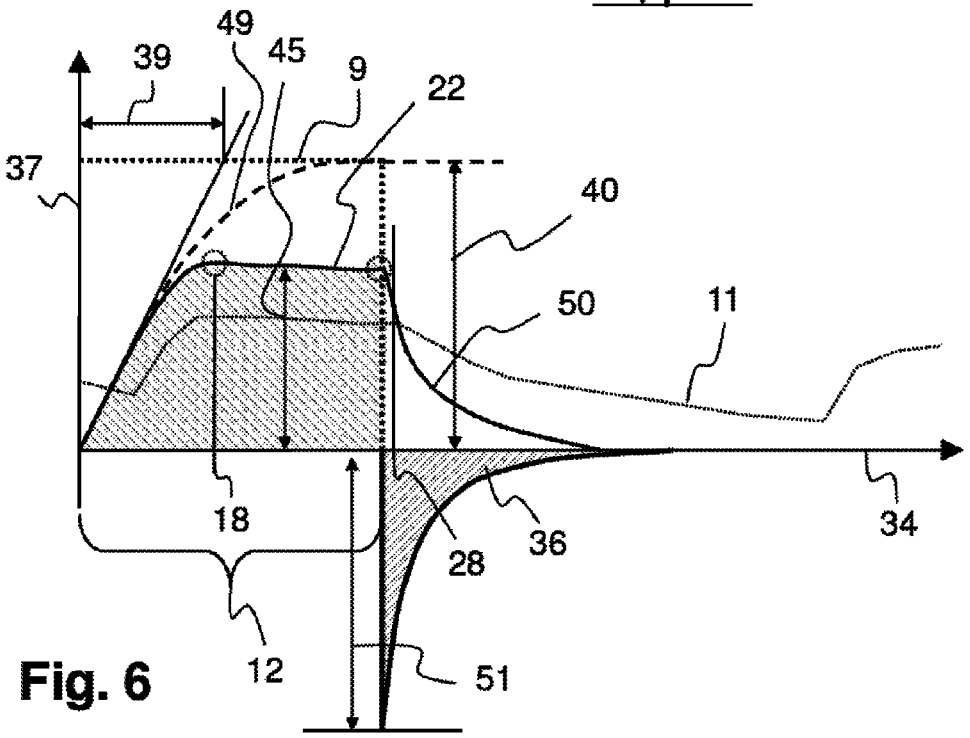
FIG. 6 is a further diagram showing a current profile in a coil.

FIG. 6 shows the diagram of FIG. 5, in which the voltage profile 9 has been adapted by the method according to the invention. The voltage profile 9 is, for the sake of simplicity, a square wave voltage in this case which has only been shortened in its duration 12. The voltage profile 9 then already ends before the fourth time 28 at which the feed piston reaches its stop. This can ensure that, on one hand, the energy loss 38 is completely avoided. Furthermore, when the feed piston is actuated with the voltage profile 9 according to FIG. 6, the feed piston does not reach the stop or has already been at least partially slowed down because acceleration of the feed piston already stops occurring before the stop is reached at the fourth time 28.

Figure 7:
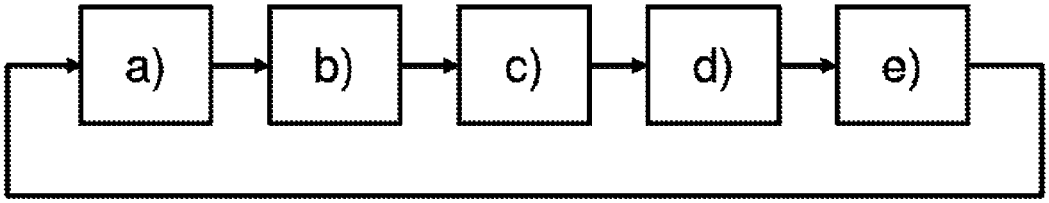
FIG. 7 is a flow chart of an embodiment variant of a method according to the invention.

FIG. 7 illustrates the method according to the invention in a one flow chart. It is apparent that the method steps a), b), c), d) and e) are carried out in a regular repeated fashion in a chronologically successive fashion in the manner of a loop. This takes place until an abort condition is met. After this, the method can be initiated again as required by regular monitoring of the pressure profile and/or of other characteristic values of the operation of the feed pump and/or of the motor vehicle.

The invention claimed is:

1. A method for operating a feed pump operating in a pulsating manner, the method comprising the following steps:

providing a feed unit having a feed pump with a feed piston and a drive coil configured to drive the feed piston, and providing the feed unit with a pressure sensor downstream of the feed pump in a feeding direction;

a) applying a voltage profile to the drive coil, the voltage profile having an overall duration and a first voltage and starting the voltage profile with an activation interval having an activation voltage, and increasing the activation voltage in relation to the first voltage;

b) carrying out a feed stroke of the feed piston in accordance with the voltage profile;

c) monitoring a pressure profile in the feeding direction downstream of the feed pump;

d) evaluating the pressure profile;

adapting at least one of the overall duration or the first voltage in step d); and e) adapting the voltage profile as a function of at least one characteristic property of the pressure profile;

determining a first point in time of a pressure peak as a characteristic property of the pressure profile; and adapting at least one of the following variables of the voltage profile as a function of the first point in time:

overall duration;

first voltage;

activation interval; or activation voltage.

2. The method according to claim 1, which further comprises:

determining at least a second point in time at which a pump valve opens or a third point in time in which a pump valve closes, as a characteristic property of the pressure profile; and additionally adapting at least one of the following variables of the voltage profile as a function of at least the second point in time or of the third point in time:

overall duration;

first voltage;

activation interval; or activation voltage.

3. The method according to claim 1, which further comprises generating the voltage profile from a supply voltage using pulse width modulation.

4. The method according to claim 1, which further comprises monitoring a current profile in the drive coil in parallel with step c) and using the current profile at least during the evaluation of the pressure profile in step d) or during the adaptation of the voltage profile in step e).

5. The method according to claim 1, which further comprises:

using at least one parameter from the following group of parameters at least during the evaluation of the pressure profile in step d) or during the adaptation of the voltage profile in step e):

energy consumption of the drive coil during a feed stroke;

outputting of energy by the feed pump to a liquid operating substance; or a return flow of energy from the drive coil after termination of a feed stroke.

6. The method according to claim 1, which further comprises operating the feed pump with a frequency of more than 10 feed strokes per second, and allowing at least 20 feed strokes to occur before carrying out a feed stroke with an adapted voltage profile.

* * * * *